United States Patent [19]

Agrawal et al.

[11] Patent Number: 4,872,893

[45] Date of Patent: Oct. 10, 1989

[54] PROCESS FOR THE PRODUCTION OF HIGH PRESSURE NITROGEN

[75] Inventors: Rakesh Agrawal, Allentown; Steven R. Auvil, Macungie, both of Pa.

[73] Assignee: Air Products and Chemicals, Inc., Allentown, Pa.

[21] Appl. No.: 254,528

[22] Filed: Oct. 6, 1988

[51] Int. Cl.[4] ..... F25J 3/00

[52] U.S. Cl. ..... 62/11; 62/39

[58] Field of Search ..... 62/11, 13, 38, 39

[56] References Cited

U.S. PATENT DOCUMENTS

| | | | |
|---|---|---|---|
| 3,736,762 | 6/1973 | Toyama et al. | 62/13 |
| 4,152,130 | 5/1979 | Theobald | 62/18 |
| 4,222,756 | 9/1980 | Thorogood | 62/13 |
| 4,372,764 | 2/1983 | Theobald | 62/38 |
| 4,400,188 | 8/1983 | Patel et al. | 62/13 |
| 4,464,188 | 8/1984 | Agrawal et al. | 62/13 |
| 4,595,405 | 6/1986 | Agrawal et al. | 62/18 |
| 4,662,916 | 5/1987 | Agrawal et al. | 62/13 |
| 4,662,917 | 5/1987 | Cormier, Jr. et al. | 62/13 |
| 4,707,994 | 11/1987 | Shenoy et al. | 62/11 |
| 4,715,873 | 12/1987 | Auvil et al. | 62/38 |

OTHER PUBLICATIONS

Celar et al: "Flexible Process of Pressure Nitrogen and Low Pressure Oxygen Production", International Congress of Refrigeration, Vienna, Austria 1987.

Ruhemann & Limb, I. Chem. E. Symposium Series, No. 79 p. 320 (1983).

*Primary Examiner*—Ronald C. Capossela

*Attorney, Agent, or Firm*—Geoffrey L. Chase; James C. Simmons; William F. Marsh

[57] ABSTRACT

A process is set forth for recovery of nitrogen from a feed gas stream, containing nitrogen and oxygen, using a cryogenic separation wherein a recycle stream having an oxygen content above that of the feed gas stream is recycled from the cryogenic separation to the feed gas stream without any intervening process step that would decrease the oxygen content of the recycle stream.

19 Claims, 2 Drawing Sheets

PROCESS FOR THE PRODUCTION OF HIGH PRESSURE NITROGEN

TECHNICAL FIELD

The present invention is directed to the cryogenic separation of nitrogen from a feed gas stream containing nitrogen and oxygen. More specifically, the present invention is directed to recovering high purity nitrogen from air using a cryogenic separation with an unexpected efficiency increase achieved by appropriate recycle of a process stream.

BACKGROUND OF THE PRIOR ART

The use of nitrogen has become increasingly important in various industrial and commercial operations. For example, liquid nitrogen is used to freeze food, in the cryogenic recycling of tires and as a source of gaseous nitrogen for inerting. Gaseous nitrogen is used in applications such as secondary oil and gas recoveries and as a blanketing gas in metal refineries, metal working operations and chemical processes. In light of the increasing importance of nitrogen in such operations, it is desirable to provide a process which is both economical and efficient for producing nitrogen in the liquid an/or gas phase.

High purity gaseous nitrogen is produced directly by well known cryogenic separation methods. U.S. Pat. No. 4,222,756 teaches a process and apparatus for producing gaseous nitrogen using multiple distillation columns and associated heat exchangers. Ruhemann and Limb, I. Chem. E. Symposium Series No. 79, page 320 (1983) advocate a preference for the use of the single distillation column instead of the typical double column for the production of gaseous nitrogen.

Liquid nitrogen is typically produced by initially producing gaseous nitrogen in a cryogenic air separation unit and subsequently treating the gaseous nitrogen in a liquefier. Modified forms of cryogenic air separation units have been developed to directly produce liquid nitrogen. U.S. Pat. No. 4,152,130 discloses a method of producing liquid oxygen and/or liquid nitrogen. This method comprises providing a substantially dry and substantially carbon dioxide-free air stream, cryogenically treating the air stream to liquefy a portion of the air stream, and subsequently feeding the air stream into a fractionation column to separate the nitrogen and oxygen and withdrawing liquid oxygen and/or nitrogen from said column.

Various process cycles using a single distillation column, with some boil-up at the bottom provided by the appropriate high pressure fluids, have also been suggested in the patent literature, for example, U.S. Pat. No. 4,400,188 and U.S. Pat. No. 4,464,188.

In U.S. Pat. No. 4,595,405 a process for the cryogenic separation of nitrogen from air is taught, wherein the cryogenic separation is conducted in a single pressure distillation column. The oxygen enriched waste gas from the cryogenic separation is rewarmed, compressed to an elevated pressure and processed through a selective membrane separation to extract oxygen from the waste stream for recovery or removal, while returning a nitrogen enriched stream to the feed air to the cryogenic separation. This process entails the additional capital outlay for compression and membrane separation. It would be logical in that patented process, designed for the recovery of nitrogen, to recycle a nitrogen-enriched stream, after membrane treatment to remove it predominantly oxygen content, as is performed in that patent.

In many of the cryogenic processes for recovery of nitrogen, the oxygen-enriched waste stream is removed from the cryogenic separation zone or distillation column and is reduced in pressure with the recovery of work in order to produce refrigeration for the feed stream being cooled for cryogenic separation. Often, there is more oxygen-enriched waste than is necessary to reduce in pressure with the recovery of work for the production of refrigeration. All of such waste cannot be processed accordingly without creating excess refrigeration. To avoid production of excess refrigeration, a portion of the waste stream is merely passed through an expansion valve, without the recovery of work, so as to minimize refrigeration production. This expansion without the recovery of work is a waste of the energy utilized to create the pressurized condition of that stream, as well as a waste of the nitrogen content of the stream.

The present invention overcomes the drawbacks of the prior art in producing high purity nitrogen using a cryogenic separation technique, wherein efficiencies are derived by the use of recycle and pressure maintenance of certain process streams as set forth below.

BRIEF SUMMARY OF THE INVENTION

The present invention is a process for the recovery of nitrogen from a feed gas stream containing nitrogen and oxygen whereby a pressurized condition is retained in an oxygen-enriched recycle process stream, comprising the steps of: compressing a feed gas stream containing nitrogen and oxygen to an elevated pressure, introducing the elevated pressure feed gas stream into a cryogenic separation zone to recover a high purity nitrogen product and an oxygen-enriched waste stream from said zone, removing an elevated pressure recycle stream having an oxygen content above that of the feed gas stream from said cryogenic separation zone, and without any intervening process steps to decrease the oxygen content of said recycle stream, recycling said stream to the feed gas stream for introduction into the cryogenic separation zone.

Preferably, said feed gas stream is air. Additionally, said elevated pressure recycles stream can be at least a portion of said oxygen-enriched waste stream.

The recycle stream can be introduced into said feed gas stream at an intermediate level of the compression of said feed gas stream.

Preferably said feed gas stream, after mixing with the recycle stream and performing further compression on the combined feed stream, is pretreated to remove water and carbon dioxide. Alternatively, said recycle stream is recompressed to said pressure of said elevated pressure feed gas stream and said recycle stream is introduced into said feed gas stream downstream of said pretreatment.

Preferably said high purity nitrogen product has a nitrogen content of at least 95%. Alternatively, said high purity nitrogen product has a nitrogen content of at least 99.5%.

Preferably, a portion of said oxygen-enriched waste stream is let down in pressure across an expander with the recovery of work to produce refrigeration for said cryogenic separation zone. Optimally, a second portion of said waste stream is recycled as said recycle stream without any substantial pressure reduction.

A preferred embodiment of the present invention is a process for the recovery of nitrogen from a feed air stream whereby a pressurized condition is retained in a portion of an oxygen-enriched waste stream which is recycled, comprising the steps of: compressing a feed air stream to an elevated pressure, pretreating said feed air stream to remove water and carbon dioxide therefrom, cooling the feed air stream by heat exchange against a rewarming process stream, introducing said cooled feed air stream into a cryogenic distillation zone, separating said feed air stream in said distillation zone into a high purity nitrogen product and an oxygen-enriched waste stream having an oxygen content above that of the feed air stream, reducing the pressure on a first portion of the said waste stream by passage through a turbine expander to produce refrigeration for cooling the feed air stream, and recycling a second portion of said waste stream to the feed air stream without substantial pressure reduction and without any intervening process step to decrease the oxygen content of said recycled second portion of said waste stream.

Preferably, said cryogenic distillation zone has a single pressure stage distillation column. Alternatively, the cryogenic distillation zone can have multiple pressure stages in the distillation column.

Preferably, an oxygen-enriched stream is removed from the base of said cryogenic distillation zone and is vaporized against a condensing nitrogen-rich stream removed from the top of said cryogenic distillation zone to produce reflux for said cryogenic distillation zone.

Alternatively, liquid nitrogen product can be produced from the process of the present invention either with or without gaseous nitrogen product. Additionally, the high purity nitrogen product can be rewarmed against the feed air stream. If needed, a third portion of said waste stream is bypassed around said expander and reduced in pressure without the recovery of work.

DETAILED DESCRIPTION OF THE INVENTION

Figure 1:
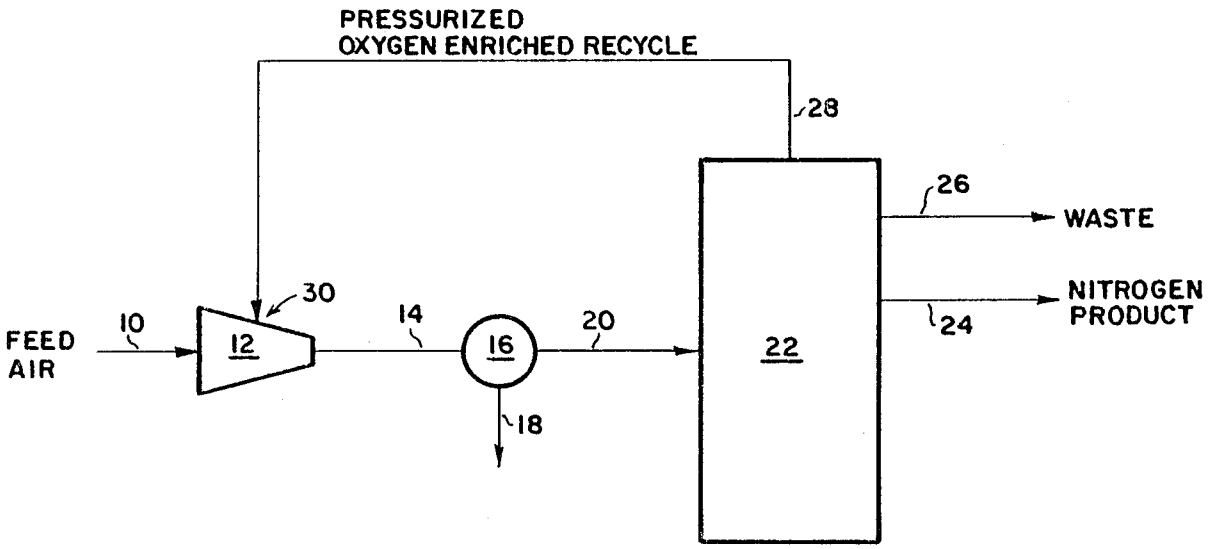
FIG. 1 is a schematic illustration of the process of the present invention.

The present invention is an efficient means to recover energy from the high pressure oxygen-enriched, nitrogen-depleted waste stream produced in a nitrogen production cryogenic separation plant. The process provides this efficiency by compressing at least a part of the oxygen-enriched waste stream and mixing it with the feed gas stream to the cryogenic separation plant. Alternatively, the waste stream can be mixed with the feed gas stream at an intermediate stage of the feed gas compression and the combined streams further compressed to the distillation zone pressure.

For nitrogen producing cryogenic plants in the size range of 30 to 250 tons/day (T/D), energy costs and capital-related investment cost play approximately equally important roles in the cost of producing nitrogen. The present invention increases the energy efficiency of such plants by 8–9% with very minimal increases in capital investment.

In nitrogen producing cryogenic air separation plants of the above size range, nitrogen is typically produced at elevated pressure from air by cryogenic distillation in a single distillation column operating at a single elevated pressure. When nitrogen is produced at high pressure. the oxygen-enriched waste stream from the column is also required to be produced at an elevated pressure greater than ambient pressure but less than the final feed gas pressure. This waste stream is expanded across an expander with recovery of work to provide refrigeration for the cryogenic facility. However, a large fraction of this gas is reduce din pressure across an expander bypass valve (J. T. valve) without the recovery of work to avoid producing excess refrigeration. This is an inefficient step from the perspective of energy utilization. In contrast, the present invention decreases the flow of the waste stream through the expander bypass valve. Instead, some of this elevated pressure, oxygen-enriched waste stream at a pressure intermediate of ambient and final feed gas pressure is brought out of the cryogenic separation facility or cold box and mixed with the feed air stream to form a combined oxygen-enriched feed to the cryogenic separation zone. This allows the recovery of some of the pressure energy and the nitrogen content in the oxygen-enriched, nitrogen-depleted waste stream. The present invention accomplishes this goal by compressing at least a part of this waste stream and mixing it with the feed gas stream to provide a combined feed gas stream of feed air and recycle gas to the cryogenic separation. The oxygen-enriched waste stream should be at a pressure greater than ambient prior to compression and mixing with the feed stream to the cryogenic separation. In a preferred mode of operation, and in order to minimize capital investment, the elevated pressure oxygen-enriched waste stream which is being recycled is fed to a suitable intermediate stage of the main feed gas compressor, and the combined feed gas stream resulting therefrom is then further compressed to form the feed gas stream to the cryogenic separation. Even though mixing of the oxygen-enriched waste stream with the feed gas stream leads to irreversible thermodynamic losses due to the oxygen enrichment of the total feed gas to the cryogenic separating zone, this improvement is beneficial to the present invention, resulting in: greater overall efficiency, improvements in overall nitrogen recovery based upon the fresh feed to the cryogenic separation zone, and minimization of capital requirements.

The main aspects of the present invention can be briefly described with reference to FIG. 1. A feed gas stream containing nitrogen and oxygen, preferably air, is introduced in line 10 to a main feed gas compressor 12 which typically has several stage of compression with intercooling. One such intermediate stage is identified as 30. The feed gas stream is mixed with a recycle stream to provide a combined feed gas stream. The feed gas stream at elevated pressure in line 14 is then pretreated in a pretreatment zone 16 to remove water, carbon dioxide and any hydrocarbons existing in the feed gas stream. These materials are removed in line 18. Typical pretreatment plants can include water chilling, refrigeration with a halofluorocarbon, such as a FREON refrigerant, as well as adsorption of residual materials on switching beds of molecular sieve material, all of which techniques are well documented in the prior art and require no specific disclosure herein.

The feed gas stream, at elevated pressure after pretreatment, is introduced in line 20 to a cryogenic separation zone 22. The cryogenic separation zone typically includes main and auxiliary heat exchangers wherein the feed gas stream is cooled close to its dew point by indirect heat exchange with rewarming process streams, as well as a distillation column, which may be single or multiple pressure stage in configuration. A nitrogen product is removed in line 24 and can comprise gaseous nitrogen, and/or a separately recovered product of liquefied nitrogen. A waste stream comprising an oxygen-enriched gas is removed in line 26. Specifically, with regard to the present invention, an oxygen-enriched, nitrogen-depleted stream is removed from the cryogenic separation zone 22 in line 28 under pressurized conditions below the final pressure of the feed gas stream but above ambient pressure, and without any intervening process steps to reduce its oxygen content, such stream is recycled to be mixed with the feed gas stream. The composition of this recycle stream 28 may or may not be the same as that of the waste stream in line 26, and its oxygen content will be above that of air.

FIG. 1 illustrates the recycle to an intermediate stage 30 of the main gas compressor 12. For this purpose, it may be necessary to reduce the pressure or boost the pressure of stream 28 to match the pressure of the intermediate stage 30 of the compressor 12. Power for this compressor can be derived from the expansion in an expander of the oxygenenriched waste.

Alternatively to FIG. 1, the recycle stream 28 may be recycled with additional separate recompression to a pressure condition allowing the recycle to be introduced into line 20. This provides the benefit of downsizing the pretreatment facility 16, while incurring the cost of separate recompression equipment in line 28.

The advantage of performing the process as illustrated in FIG. 1 is that the oxygen-enriched stream of line 28 would traditionally be reduced in pressure either for refrigeration or through a bypass JT valve in the prior art during the process of removal of such a waste stream in a nitrogen generating process. The present invention retains the pressurized condition of the oxygen-enriched recycle stream in line 28 and blends the same with the feed gas stream to the separation zone 22 despite the fact that the recycle is oxygen enriched and the feed gas stream is introduced to the cryogenic separation zone 22 to produce nitrogen product. The water stream in line 26 may also constitute a desirable product stream if oxygen concentrations meet and use applications.

The unexpected results of the present invention are that the recovery of the minor amount of nitrogen in the recycle stream 28 and the recoupment of the pressurized condition of such stream provides efficiencies which overcome the thermodynamic inefficiency of recycling an oxygen-enriched stream to the feed gas into a nitrogen producing process. In summary, the inefficiency of mixing the oxygen-enriched recycle with the feed gas stream is less than the inefficiency of reducing its pressure across a valve and venting to atmosphere.

The present invention will now be described with reference to a preferred detailed embodiment illustrated in FIG. 2. A feed air stream 210 is introduced into a multistage main air compressor 212 and elevated in pressure to approximately 124.4 psia in line 214. A recycle stream 228 is introduced in one of the intermediate stages of the compressor to provide the combined feed gas stream. The combined feed gas stream is cooled by indirect heat exchange with cooling water in aftercooler 213. The feed gas stream is further cooled in a refrigerated heat exchanger 215 to condense water, which is removed in phase separation vessel 217. Residual water and carbon dioxide, as well as trace hydrocarbons, are removed from the feed gas stream in a mole sieve switching bed adsorption system 219, wherein the feed is passed through one parallel bed until regeneration is required and then the feed is switched to pass through the other bed while regeneration occurs. Such a switching adsorptive clean-up is well known in the art and does not require greater elaboration. The aftercooler 213, the refrigerated cooler 215, the phase separation vessel 217 and the switching adsorptive beds 219 collectively constitute a pretreatment stage 216.

The elevated pressure, clean and dry feed gas stream in line 220 is then introduced into the main heat exchanger 233 to be cooled against rewarming gaseous nitrogen, a recycle stream and a waste stream. The cooled feed gas stream at −269° F. is introduced in line 225 into a single pressure stage distillation column 227 which is constructed with the appropriate traditional trays for countercurrent rectification. Vapor which is slowly enriching in nitrogen ascends the column 227, while liquid slowly enriching in oxygen descends the column. An oxygen-enriched stream is removed from the base of the column 227 in line 237 and reduced in pressure through valve 239 before being introduced to the overhead of the column to provide cooling by indirect heat exchange in a boiling/condensing heat exchanger 231. Vaporous nitrogen enriched gas passes from the distillation column 227 overheads into the heat exchanger 231 and is condensed against the rewarming oxygen-enriched gas and is returned as liquid for reflux in line 233 and as a liquid nitrogen product (LIN) in line 235. The remaining vaporous nitrogen having a high purity of at least 95%, and preferably at least 99.5%, is removed in line 229 and rewarmed in the main heat exchanger 223 against the feed gas stream in line 220. The high purity rewarmed nitrogen gas (GAN) is removed as a product at a pressure of 115 psia in line 224.

The rewarmed oxygen-enriched gas from the overhead boiling/condensing heat exchanger 231 is removed in line 243 at a pressure of 53 psia and −283.4° F. This stream is utilized to produce the refrigeration for the cryogenic separation. To achieve this refrigeration, a first portion of the waste stream in line 243 is removed in line 245 for pressure reduction. The remaining waste stream in line 247 is partially rewarmed in the main heat exchanger 223 before some of the remaining waste is separated in line 249 for combination with the first portion in line 245, which is combined in line 251. Most of the waste stream in line 251 is reduced in pressure with the recovery of work by expanding in an expander turbine 257 resulting in significant cooling of the resulting low pressure gas. A third portion of the waste gas stream in line 253 is bypassed around the expander turbine 257 and is reduced in pressure without recovery of work in a bypass valve operating with the Joule-Thompson effect identified as 255. This bypassed third portion of the waste stream is reduced in pressure without recovery of work in order to avoid excess refrigeration and is combined with the turbine-expanded waste stream in line 259. This waste stream in line 259 comprises the main refrigeration source in the main heat exchanger 223, wherein the gas is rewarmed against the cooling feed gas stream in line 220. The low pressure oxygen-enriched waste gas stream is removed in line 226 and vented. A portion of this stream 226 can be used to regenerate molecular sieve pretreatment beds if they are included in the facility. Stream 226 could also be a useful product if its oxygen content is appropriate for end use applications.

A second portion of the oxygen-enriched waste gas stream is diverted around the pressure reduction valve 255 and expander turbine 257 and without any further process steps, such as membrane separation which would affect or specifically decrease the oxygen content of the gas, is recycled in line 228 back to the feed air stream. The recycle stream can be introduced into an intermediate stage 230 of the multistage main air compressor 212, so as to recoup its pressure value and its nitrogen value.

Although it would appear inconsistent in a nitrogen recovery cryogenic separation to introduce an oxygen-enriched stream into the feed air stream to the separation, it has been unexpectedly found by the present inventors that the recited recycle reduces the relative power requirements of the process over a cycle with no recycle and actually increases the recovery of nitrogen based upon fresh air feed to the overall process. This is based upon the fact that the extent of recycle only diminishes the nitrogen content of the feed 225 going to the distillation column 227 to result in a nitrogen entry concentration of 72%. If only air were fed to the distillation column, the nitrogen concentration would be 79%. This inefficiency of performing the recycle is found to be less than the inefficiency of reducing the pressure of the recycle stream across the JT valve 255 and venting that stream as a waste stream. This advantage is manifested in the relationship between the distillation column 227, the refrigeration source 255 and 257, and the main heat exchanger 223, all of which make up the cryogenic separation zone or cold box 222.

In order to demonstrate the value of performing a recycle of even an oxygen-enriched waste gas stream to the feed air stream, the following comparison of the prior art without recycle is made with three embodiments of the present invention utilizing such a recycle.

EXAMPLE 1

Figure 2:
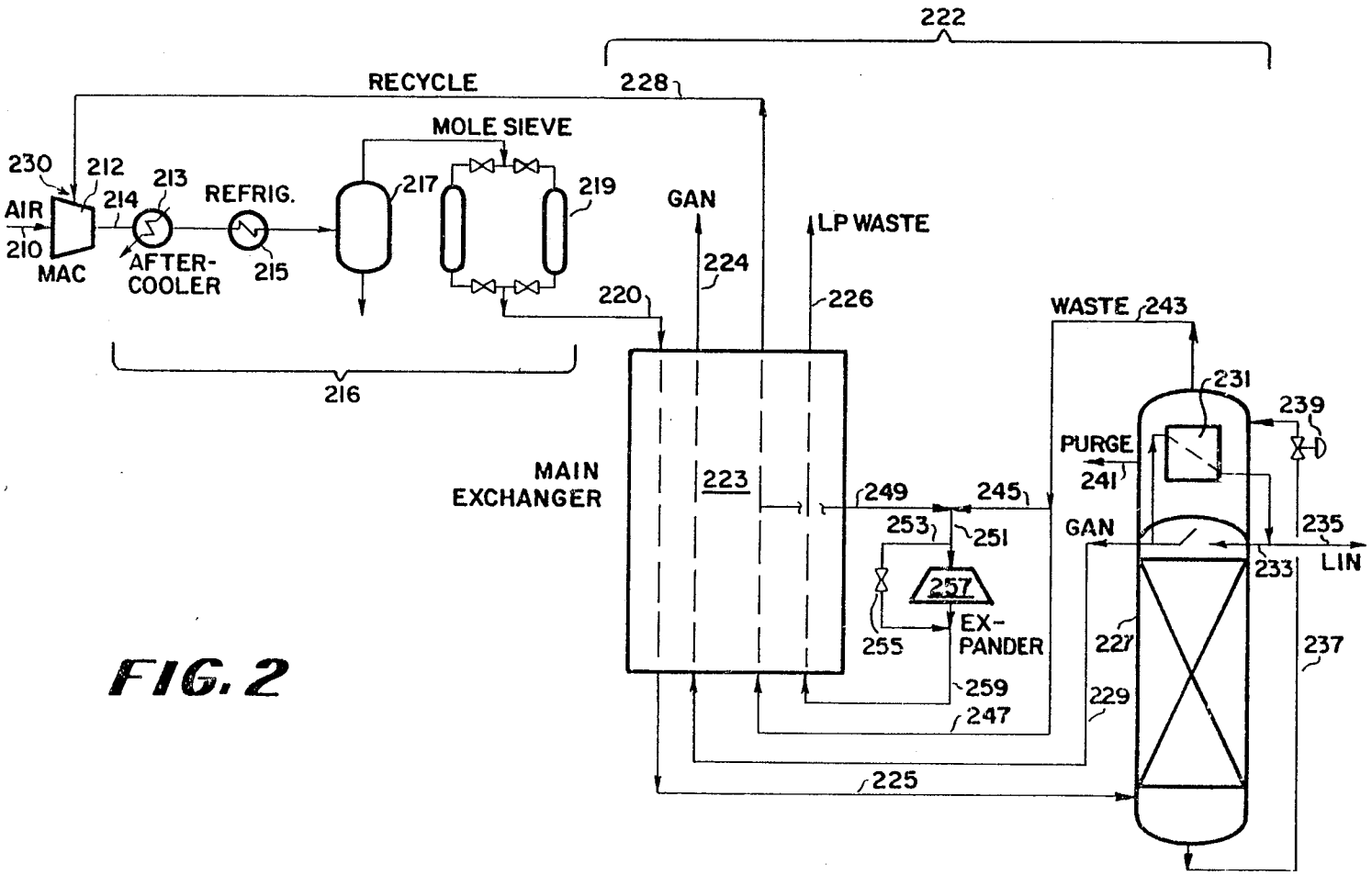
FIG. 2 is a schematic illustration of a preferred embodiment of the present invention.

Calculations were done by computer simulation of a process as shown in FIG. 2 wherein no recycle in line 228 was performed and some of the waste gas is expanded across expander 257 and the remaining waste gas is passed through the bypass valve 255. The inefficiency herein is due to the gas required to be passed through the bypass valve 255 without recoupment of energy and which is thereafter merely vented from the process. The calculation produced 87 T/D of gaseous nitrogen at 115 psia and 1.7 T/D of liquid nitrogen. The ambient conditions used where 14.7 psia, 70° F., and 50% relative humidity. Some of the pertinent results are illustrated in Table 1 below. It is seen that a large flow (about 32% of the feed air) bypasses the expansion turbine and the amount of nitrogen recovered relative to the total nitrogen feed air is 52.8%.

EXAMPLE 2

In this example, computer simulation calculations were done according to the present invention as embodied in the process shown in FIG. 2. These examples included the recycle of a portion of the waste stream in line 228 without any attempt to decrease the oxygen enriched character of the stream. The product mix and conditions were the same as those given for Example 1 above. In this process, the amount of the recycle stream 228 can be controlled. When a smaller amount is recycled, a larger amount of flow is expanded across the expander bypass valve and vice versa. The concentration of oxygen in the main air compressor discharge is also dependent on the recycle flow. The concentration of oxygen increases with an increase in the recycle flow and decreases with a decrease in the recycle flow. The following three cases were performed for different recycle flows by computer simulation under Example 2 as set forth below.

CASE I

In this embodiment, 109 pound moles/hr of the oxygen-enriched, nitrogen-depleted waste gas stream containing about 40% oxygen is recycled to the main air compressor. The flow through the expander bypass valve is now 107 pound moles/hr as compared to 203 pound moles/hr for Example 1 (see table 1). Due to this recycle flow, the amount of feed air flow is decreased to 551 pound moles/hr. The concentration of oxygen in the stream at the discharge of the main air compressor is 24%. High concentrations of oxygen present safety hazards and require expensive compressors, whereas the concentration of 24% oxygen allows the use of a less expensive apparatus. In comparison, for fresh air feed, the oxygen concentration on a dry basis would be 21%. As seen from Table 1, the power consumed by this Case I of Example 2 is about 6.5% lower than the calculated power for Example 1 without a recycle. This is substantial savings in power using the recycle, especially considering the fact that the additional capital investment for Case I of this Example 2 is minimal with regard to the requirements of Example 1.

CASE II

The recycle flow of the oxygen-enriched, nitrogen-depleted waste stream in this case is increased to 156 pound moles/hr. It has about 42.6% oxygen and the concentration of oxygen in the main air compressor discharge is 26%. The process details for this Case II are set forth in Table 1. The flow through the expander bypass valve is further reduced to 75 pound moles/hr. A remarkable power savings of about 8% is observed for this Case II over the Example 1 case using no recycle.

CASE III

When the recycle flow is further increased to 221 pound moles/hr, the concentration of oxygen in the main air compressor discharge increases to 29%. The expander bypass flow decreases to 39 pound moles/hr. There is some more energy savings for this Case III; however, as compared to Case II, it is a small increase. The overall energy savings as compared to that calculated for Example 1 above is 8.5% for this Case III.

The energy savings for all three cases of Example 2, demonstrating the recycle of the present invention as illustrated in FIG. 2, are quite encouraging and prove the applicability of the present invention. The results of the efficiency comparison with recycle versus non-recycle as set forth in Table 1 below:

TABLE 1

Pertinent Calculation Results for Examples 1 & 2
Product: 87 T/D GAN at 115 psia
1.7 T/D LIN

| | | Example 2 | | |
|---|---|---|---|---|
| | Example 1 | Case I | Case II | Case III |
| Oxygen in Feed to Cold Box (%) (Stream 20 or 225) | 21 | 24 | 26 | 29 |
| Oxygen in Waste (%) (Stream 26 or 226) | 35.6 | 40.1 | 42.6 | 46.4 |

TABLE 1-continued

Pertinent Calculation Results for Examples 1 & 2

Product: 87 T/D GAN at 115 psia
1.7 T/D LIN

| | Example 1 | Example 2 Case I | Case II | Case III |
|---|---|---|---|---|
| Recycle Stream Flow (lb moles/hr) (Stream 28 or 228) | — | 109 | 156 | 221 |
| Expander Bypass Flow (lb moles/hr) (Stream 253) | 203 | 107 | 75 | 39 |
| Feed Air Flow (lb moles/hr) (Stream 10 or 210) | 639 | 551 | 518 | 480 |
| $N_2$ Recovery from Air Feed (%) | 52.8 | 61.3 | 65.2 | 70.3 |
| Relative Power | 1.0 | 0.935 | 0.919 | 0.913 |

The prior art processes which fail to use a recycle stream are a tradeoff between capital and energy costs. In a plant size in the range of 30 to 250 T/D of nitrogen contained in the product gas, any process is designed to minimize the number of equipment items of significant capital cost. As a result, in order to produce high pressure, gaseous nitrogen product, no gaseous nitrogen compressor is used. Also, in certain applications, due to the possibility of contamination of the gaseous nitrogen, it is not advisable to use a product compressor on ultra high purity nitrogen from the cryogenic separation zone. Either of these considerations leads to a process with significant energy losses, since a substantial amount of oxygen-enriched waste gas must be expanded across a bypass valve, to the exclusion of any recycle without substantial pressure reduction. In contrast, the present invention provides a scheme to limit the amount of gas expanded across this valve, without significant additional capital requirements, such as the membrane used in the prior art, which nitrogen enriches the waste which is recycles. Instead, the present invention is designed to take a significant fraction of the oxygen-enriched waste gas out of the cryogenic separation zone at a high pressure and mixes this gas with feed gas stream at a suitable stage either in the main feed gas compressor or downstream of the feed gas stream pretreatment zone. This allows the process of the present invention to take advantage of reduced power requirements, lower capital costs, and increased recovery in comparison to the prior art.

The scope of the present invention should be ascertained from the claims which follow.

We claim:

1. A process for the recovery of nitrogen from a feed gas stream containing nitrogen and oxygen whereby a pressurized condition is retained in an oxygen-enriched recycle process stream comprising the steps of:

(a) compressing a feed gas stream containing nitrogen and oxygen to an elevated pressure;

(b) introducing the elevated pressure feed gas stream into a cryogenic separation zone to recover a high purity nitrogen product and an oxygen-enriched waste stream from said zone, and (c) removing an elevated pressure recycle stream, having an oxygen content above that of the feed gas stream of step (a), from said cryogenic separation zone and at least maintaining the oxygen content of said recycle stream, recycling said stream at elevated pressure to the feed gas stream for introduction into the cryogenic separation zone.

2. The process of claim 1 wherein said feed gas stream is air.

3. The process of claim 1 wherein said elevated pressure recycle stream is at least a portion of said oxygen-enriched waste stream.

4. The process of claim 1 wherein said recycle stream is introduced into said feed gas stream at an intermediate level of the compression of said feed gas stream.

5. The process of claim 1 wherein said elevated pressure feed gas stream is pretreated to remove water, carbon dioxide and other contaminants.

6. The process of claim 5 wherein said recycle stream is recompressed to said pressure of said elevated pressure feed gas stream and said recycle stream is introduced into said feed gas stream downstream of said pretreatment.

7. The process of claim 1 wherein said high purity nitrogen product has a nitrogen content of at least 95% nitrogen by volume.

8. The process of claim 1 wherein said high purity nitrogen product has a nitrogen content of at least 99.55 nitrogen by volume.

9. The process of claim 1 wherein a first portion of said oxygen-enriched waste stream is expanded through an expander to extract work and produce refrigeration for said cryogenic separation zone.

10. A process for the recovery of nitrogen from a feed gas stream comprising air whereby a pressurized condition is retained in a portion of an oxygen-enriched waste stream which is recycled, comprising the steps of:

(a) compressing a feed gas stream to an elevated pressure;

(b) pretreating said feed gas stream to remove water and carbon dioxide therefrom;

(c) cooling the feed gas stream by heat exchange against a rewarming process stream;

(d) introducing said cooled feed gas stream into a cryogenic distillation zone;

(e) separating said feed gas stream in said distillation zone into a high purity nitrogen product and an oxygen-enriched waste stream having an oxygen content above that of air;

(f) reducing the pressure on a first portion of said waste stream by expanding through an expander with the recovery of work to produce refrigeration for step (c); and (g) recycling a second portion of said waste stream to the feed gas stream while substantially maintaining its pressure and at least maintaining the oxygen content of said recycled second portion of said waste stream.

11. The process of claim 10 wherein said second portion of said waste stream is introduced into said feed gas stream at an intermediate level of the compression of said feed air stream.

12. The process of claim 10 wherein said second portion of said waste stream is recompressed to said elevated pressure of said feed gas stream and said second portion is introduced into said feed gas stream downstream of said pretreatment.

13. The process of claim 10 wherein said cryogenic distillation zone has a single pressure stage.

14. The process of claim 10 wherein an oxygen-enriched stream is removed from the base of said cryogenic distillation zone and is vaporized against a condensing nitrogen-rich stream removed from the top of said cryogenic distillation zone to produce reflux of said cryogenic distillation zone from said condensing nitrogen-rich stream.

15. The process of claim 10 wherein said high purity nitrogen product has a nitrogen content of at least 95% nitrogen by volume.

16. The process of claim 10 wherein said high purity nitrogen product has a nitrogen content of at least 99.5% nitrogen by volume.

17. The process of claim 10 wherein a liquid nitrogen product is produced.

18. The process of claim 10 wherein the high purity nitrogen product is rewarmed against the feed gas stream.

19. The process of claim 10 wherein a third portion of said waste stream is bypassed around said expander and reduced in pressure without the recovery of work.

* * * * *

UNITED STATES PATENT AND TRADEMARK OFFICE

CERTIFICATE OF CORRECTION

PATENT NO. : 4,872,893

DATED : October 10, 1989

INVENTOR(S) : Agrawal, et al

It is certified that error appears in the above-identified patent and that said Letters Patent is hereby corrected as shown below:

Column 10, Line 21
Replace "99.55" with -- 99.5% --

Signed and Sealed this

Twelfth Day of February, 1991

*Attest:*

HARRY F. MANBECK, JR.

*Attesting Officer*

*Commissioner of Patents and Trademarks*